US008191597B2

(12) United States Patent
Vulpitta

(10) Patent No.: US 8,191,597 B2
(45) Date of Patent: Jun. 5, 2012

(54) TAPE DISPENSER

(75) Inventor: Brian A. Vulpitta, Avon Lake, OH (US)

(73) Assignee: Shurtech Brands, LLC, Avon, OH (US)

( * ) Notice: Subject to any disclaimer, the term of this patent is extended or adjusted under 35 U.S.C. 154(b) by 338 days.

(21) Appl. No.: 12/575,069

(22) Filed: Oct. 7, 2009

(65) Prior Publication Data

US 2010/0084450 A1 Apr. 8, 2010

Related U.S. Application Data

(60) Provisional application No. 61/103,327, filed on Oct. 7, 2008.

(51) Int. Cl.
*B65D 85/02* (2006.01)
*B32B 37/22* (2006.01)

(52) U.S. Cl. ..... 156/577; 156/574; 225/65; 225/80

(58) Field of Classification Search ..... 156/574, 156/577, 579; 206/411; D19/69; 225/46, 225/56–66, 77–80
See application file for complete search history.

(56) References Cited

U.S. PATENT DOCUMENTS 3,187,968 A * 6/1965 Favre ..... 225/56
D259,643 S 6/1981 Pearson
4,961,525 A 10/1990 Corbo et al.
5,071,051 A 12/1991 Corbo et al.
D361,086 S 8/1995 Thompson et al.
D362,684 S 9/1995 Samuelson et al.
5,468,332 A 11/1995 Dretzka et al.
5,672,238 A * 9/1997 Samuelson ..... 156/579
5,820,005 A 10/1998 Perkitny et al.
5,851,347 A 12/1998 Rodriguez
D423,054 S 4/2000 Harris
D438,567 S * 3/2001 Van Den Berg ..... D19/69
D442,227 S 5/2001 Carlson et al.
D448,413 S 9/2001 Carlson et al.
6,669,070 B2 12/2003 Huang
6,719,180 B2 4/2004 Shah
6,874,554 B2 4/2005 Chandaria
D507,020 S 7/2005 Mueller et al.
6,913,060 B2 7/2005 Chandaria
6,923,358 B2 8/2005 Chandaria
7,021,356 B2 4/2006 Kelders et al.
7,077,185 B2 * 7/2006 Steinberger ..... 156/527
7,093,640 B2 8/2006 Chandaria
D529,093 S 9/2006 Gullicks et al.
D533,594 S 12/2006 Gullicks et al.
D533,905 S 12/2006 Gullicks et al.
D534,589 S 1/2007 Gullicks et al.
(Continued)

*Primary Examiner* — Mark A Osele
(74) *Attorney, Agent, or Firm* — Fay Sharpe LLP

(57) ABSTRACT

A tape dispenser is adapted to dispense lengths of adhesive tape from a roll of adhesive tape wound upon a cylindrical tape core. The tape dispenser comprises a first sidewall and a second sidewall generally parallel to the first sidewall. Each sidewall has a hub structure, a tape retaining tab, and a foot portion located between the hub structure and the tab. The tape core is rotatably supported on the hub structures of the first and second sidewalls. A tape guide portion interconnects the first and second sidewalls. A cutter is located at a forward end of the tape guide portion. A roller is rotatably supported between the sidewall front portions. The roller is beneath the tape guide portion and adjacent the cutter. The tape dispenser is configured to allow a user to only use one hand to hold the tape dispenser and dispense a length of tape on an associated substrate.

17 Claims, 11 Drawing Sheets

U.S. PATENT DOCUMENTS

| | | | | |
|---|---|---|---|---|
| D553,685 | S | 10/2007 | Thorsteinsson et al. | |
| D568,400 | S | 5/2008 | Packard et al. | |
| 7,370,782 | B2 | 5/2008 | Thompson et al. | |
| D573,645 | S | 7/2008 | Sommers et al. | |
| D588,646 | S | 3/2009 | Vulpitta | |
| D591,354 | S | 4/2009 | Vulpitta | |
| 2002/0079346 | A1* | 6/2002 | Yu | 225/57 |
| 2004/0154751 | A1* | 8/2004 | Chandaria | 156/577 |
| 2010/0018653 | A1* | 1/2010 | Dureiko et al. | 156/510 |

* cited by examiner

TAPE DISPENSER

CROSS REFERENCE TO RELATED APPLICATIONS

The present application claims priority from U.S. Provisional Patent Application Ser. No. 61/103,327 filed 7 Oct. 2008, which provisional patent application is expressly incorporated herein by reference, in its entirety.

BACKGROUND

Exemplary embodiments herein relate to tape dispensers and more particularly to hand-held dispensers for adhesive tape such as packaging tape and the like.

Adhesive tape is used in many applications by consumers and businesses. One type of adhesive tape is sometimes called packaging tape. Packaging tape is frequently sold as rolls of tape which is approximately two inches wide. It comes in various lengths from a few yards to 100 yards and beyond. The tape normally consists of a plastic film with an adhesive on one side. The adhesive tape is wound upon a cylindrical core, which is often made from either a cardboard or a plastic material. Consumers and businesses often use packaging tape to seal boxes. A length of the tape is removed from the roll and applied to the flaps of the box to close the box. Packaging tape is also used in other similar applications. Packaging tape comes in various colors, forms, and with various attributes. Some tapes have filaments to reinforce the tape. Other tapes have particularly clear plastic films. Other tapes have different kinds of adhesives for different applications. "Packaging tape" is used herein to mean adhesive tape having a plastic film of substantially uniform width with adhesive on one side rolled in many turns upon a core.

Packaging tapes are often used on a dispenser. Many inexpensive dispensers are available for use with packaging tape. Rolls of packaging tape are often sold on a dispenser as consumers and some small businesses find buying a roll of tape on a dispenser to be more convenient and cost effective. To be attractive to consumers, a dispenser for packaging tape should be easy to use, apply tape to a substrate reliably, cut tape from the roll of tape after application of tape, and be inexpensive. Reusability of a tape dispenser is also a positive attribute.

BRIEF DESCRIPTION

According to one aspect, a tape dispenser is adapted to dispense lengths of adhesive tape from a roll of adhesive tape wound upon a cylindrical tape core. The tape dispenser comprises a first sidewall and a second sidewall generally parallel to the first sidewall. Each sidewall has a hub structure, a tape retaining tab, and a foot portion located between the hub structure and the tab. The tape core is rotatably supported on the hub structures of the first and second sidewalls. A tape guide portion interconnects the first and second sidewalls. A cutter is located at a forward end of the tape guide portion. A roller is rotatably supported between the sidewall front portions. The roller is beneath the tape guide portion and adjacent the cutter. The tape dispenser is configured to allow a user to only use one hand to hold the tape dispenser and dispense a length of tape on an associated substrate.

According to another aspect, a tape dispenser is adapted to dispense lengths of adhesive tape from a roll of adhesive tape wound upon a cylindrical tape core. The tape dispenser comprises a one piece frame including a first generally planar sidewall and a second generally planar sidewall generally parallel to the first sidewall. Each sidewall has a front portion, a rear portion, an inwardly projecting hub structure in the rear portion, an inwardly projecting tape retaining tab in the front portion, and a foot portion having a bottom positioned between the hub structure and the tab and below the hub portion. A tape guide portion is generally perpendicular to the first and second sidewalls and connects the sidewall front portions. The tape guide portion has a forward end. A cutter is located at the forward end of the tape guide portion. A cylindrical roller, separate from the one piece frame, is rotatably supported between the sidewall front portions.

According to yet another aspect, a tape dispenser is adapted to dispense lengths of adhesive tape from a roll of adhesive tape wound upon a cylindrical tape core. The tape dispenser comprises a first sidewall and a second sidewall generally parallel to the first sidewall. Each sidewall has an inwardly extending hub structure, an inwardly extending tape retaining tab, and a foot portion located between the hub structure and the tab. The tape core is rotatably supported on the hub structures of the first and second sidewalls. The tape retaining tabs are configured to allow the tape to slide over the tabs without sticking or binding but still be retained above the tabs during dispensing of a length of tape on an associated substrate and at rest. A tape guide portion interconnects the first and second sidewalls. A tape brake extends rearwardly from the tape guide portion. The tape brake is unconnected to the first sidewall and the second sidewall. A cutter is located at a forward end of the tape guide portion. A roller is rotatably supported between the sidewall front portions, The roller is beneath the tape guide portion and adjacent the cutter.

Figure 1:
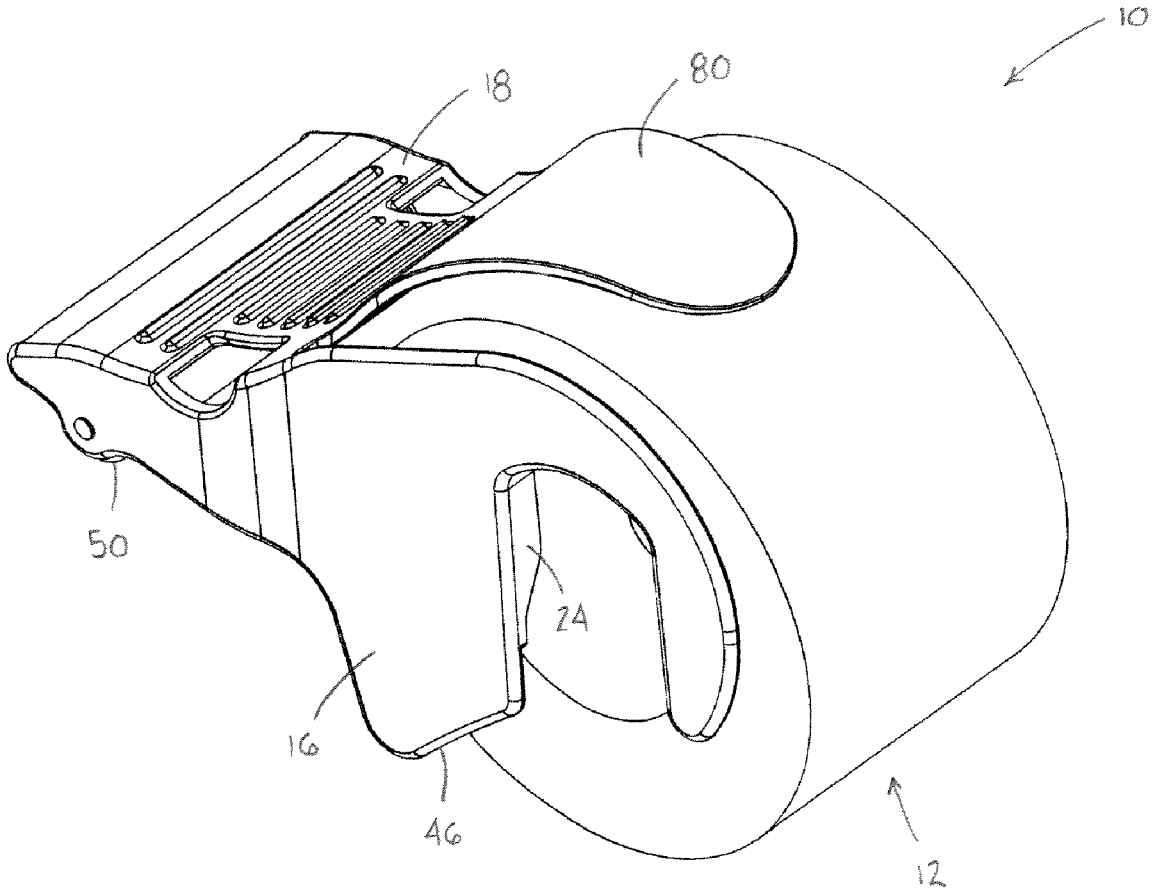
FIGS. 1 and 2 are perspective views showing a tape dispenser in accordance with the present invention with a roll of tape mounted on the tape dispenser.
Figure 2:
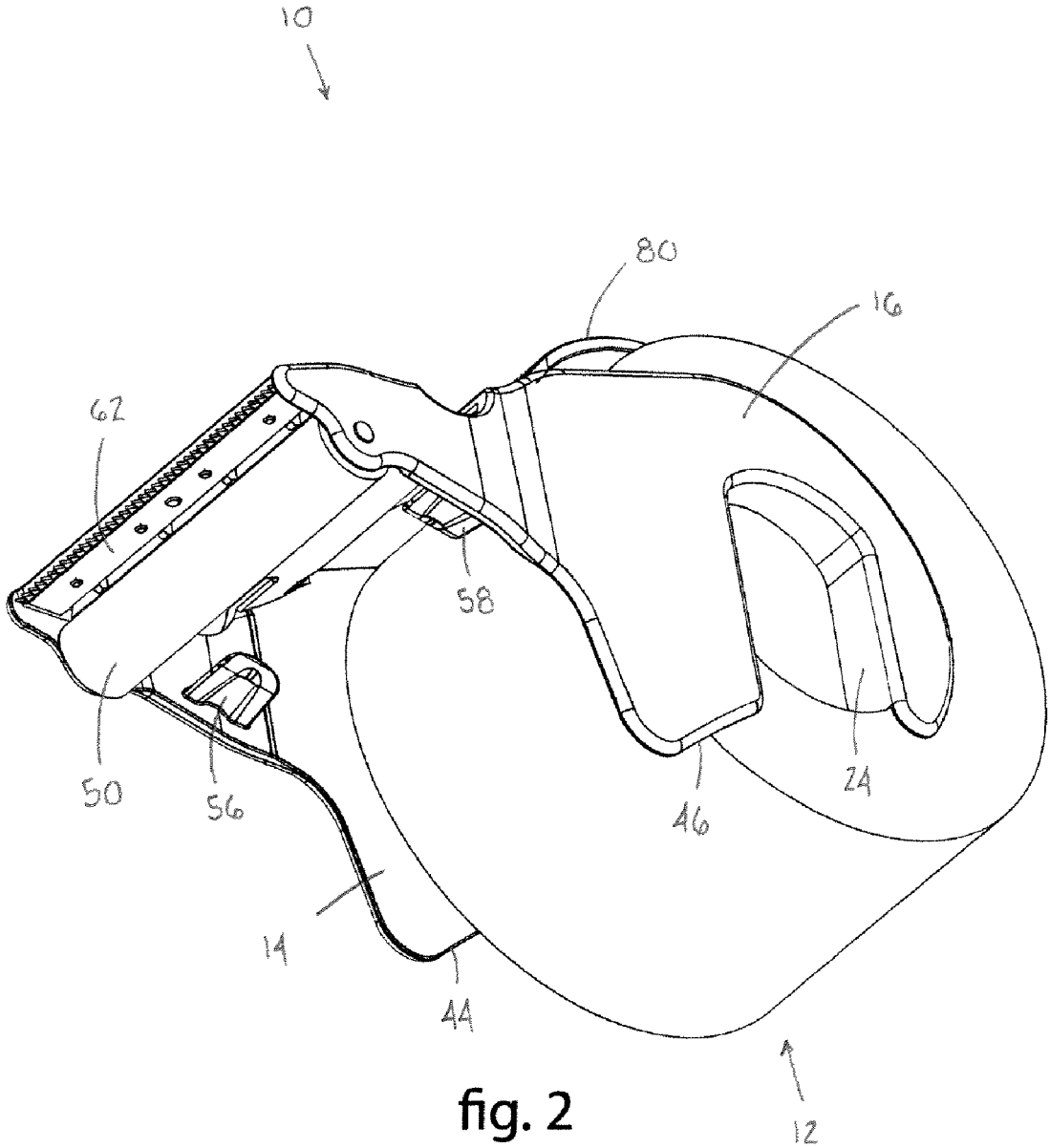
Figure 6:
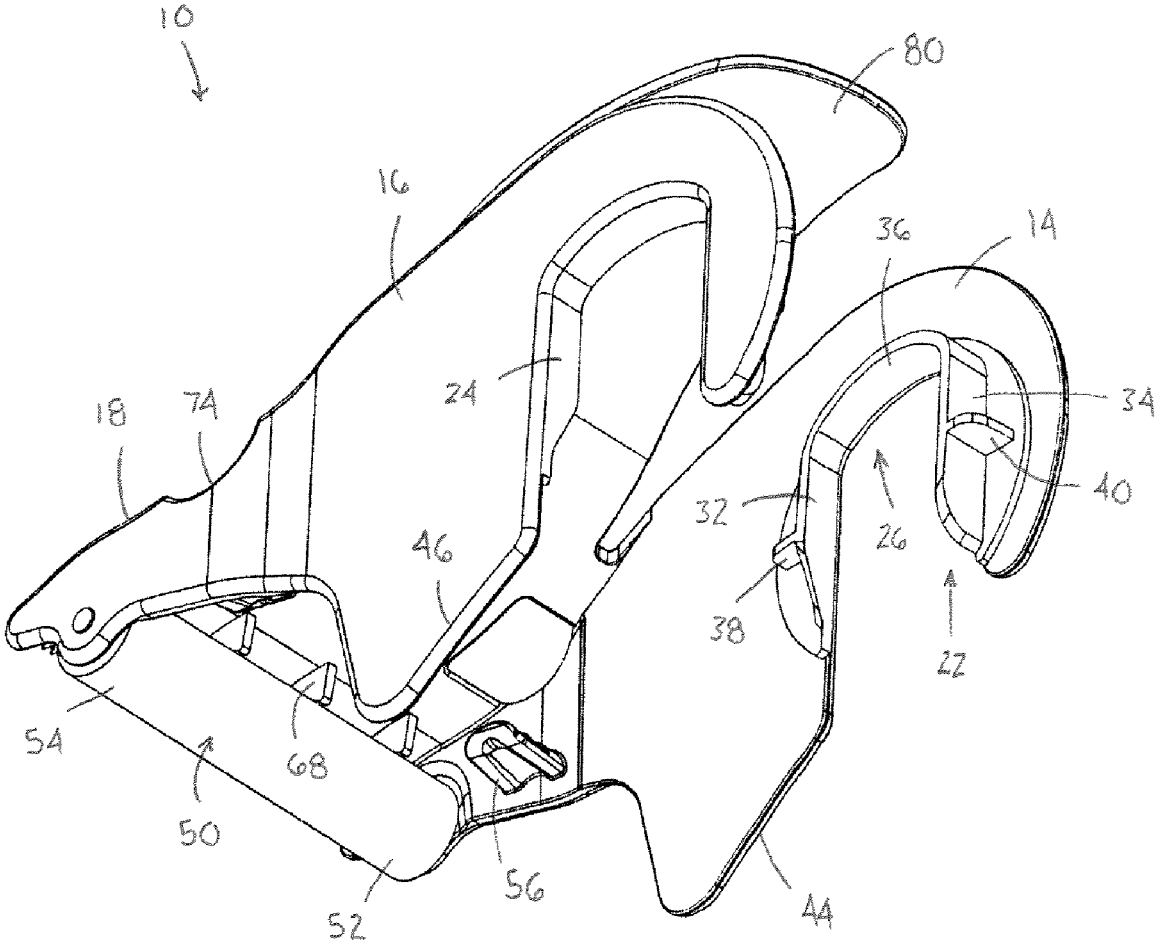
Figure 7:
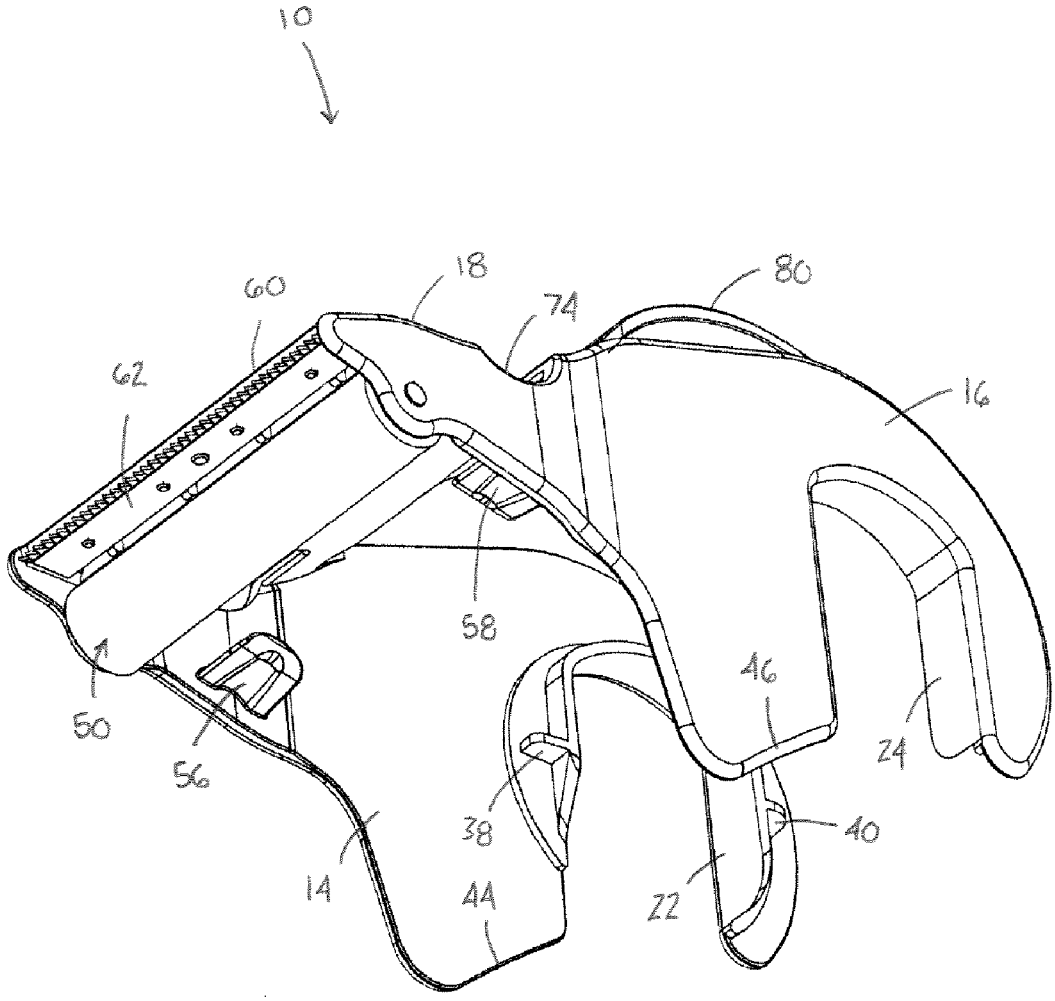
Figure 8:
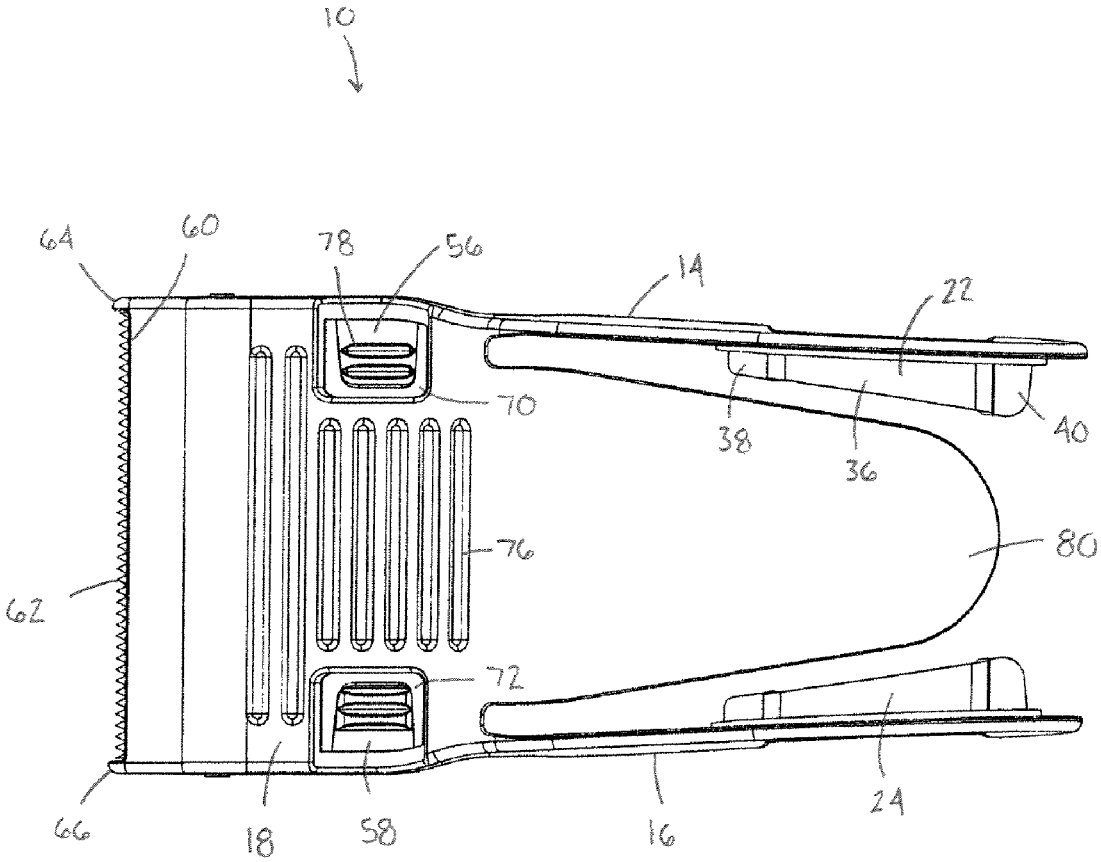
Figure 9:
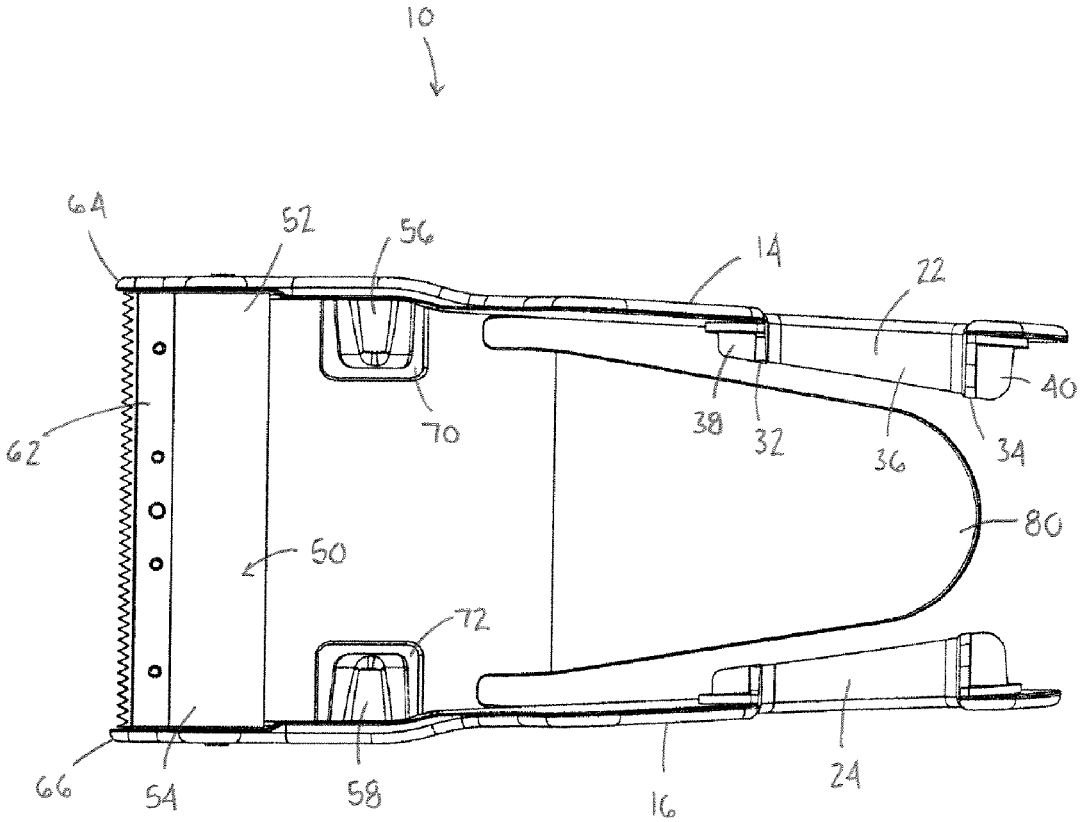
Figure 10:
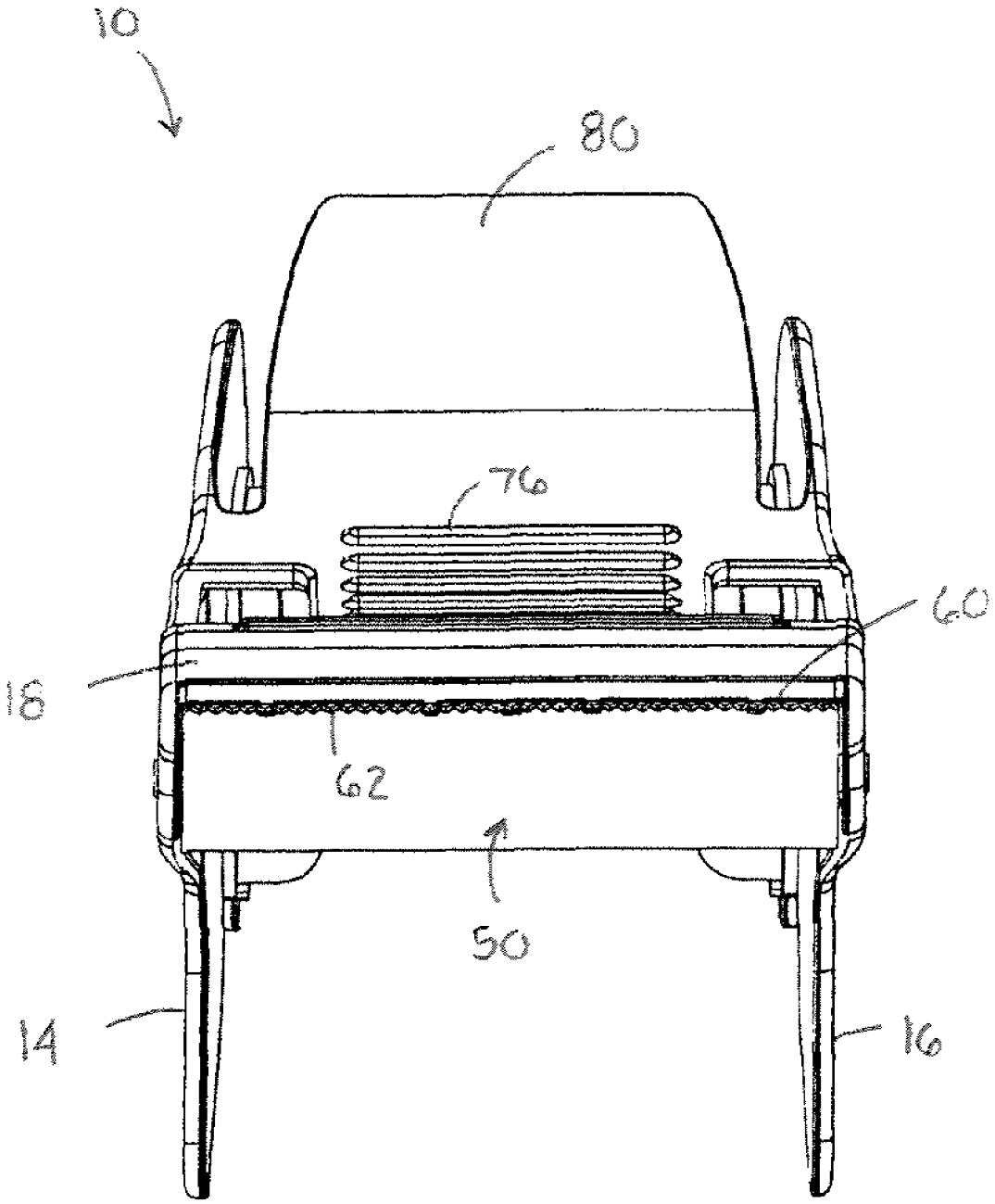

perspective top view of the dispenser and roll of tape of FIG. 1;

FIGS. 4 through 7 are perspective views showing the tape dispenser of FIGS. 1 and 2 without the roll of tape;

FIG. 8 is a top view of the tape dispenser of FIGS. 4-7;

FIG. 9 is a bottom view of the tape dispenser of FIGS. 4-7;

FIG. 10 is a front view of the tape dispenser of FIGS. 4-7; and

Figure 11:
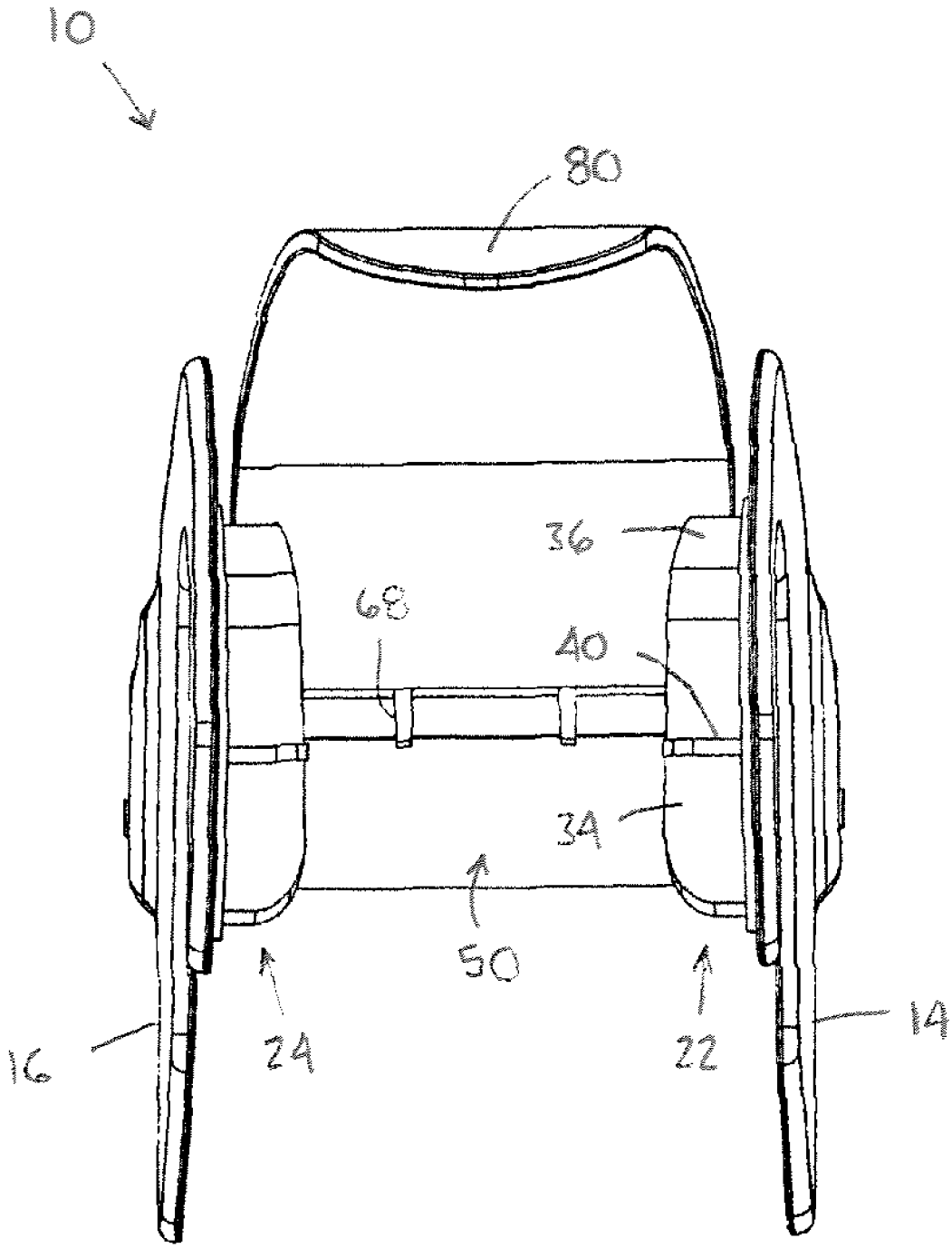

FIG. 11 is a rear view of the tape dispenser of FIGS. 4-7.

DETAILED DESCRIPTION

Figure 3:
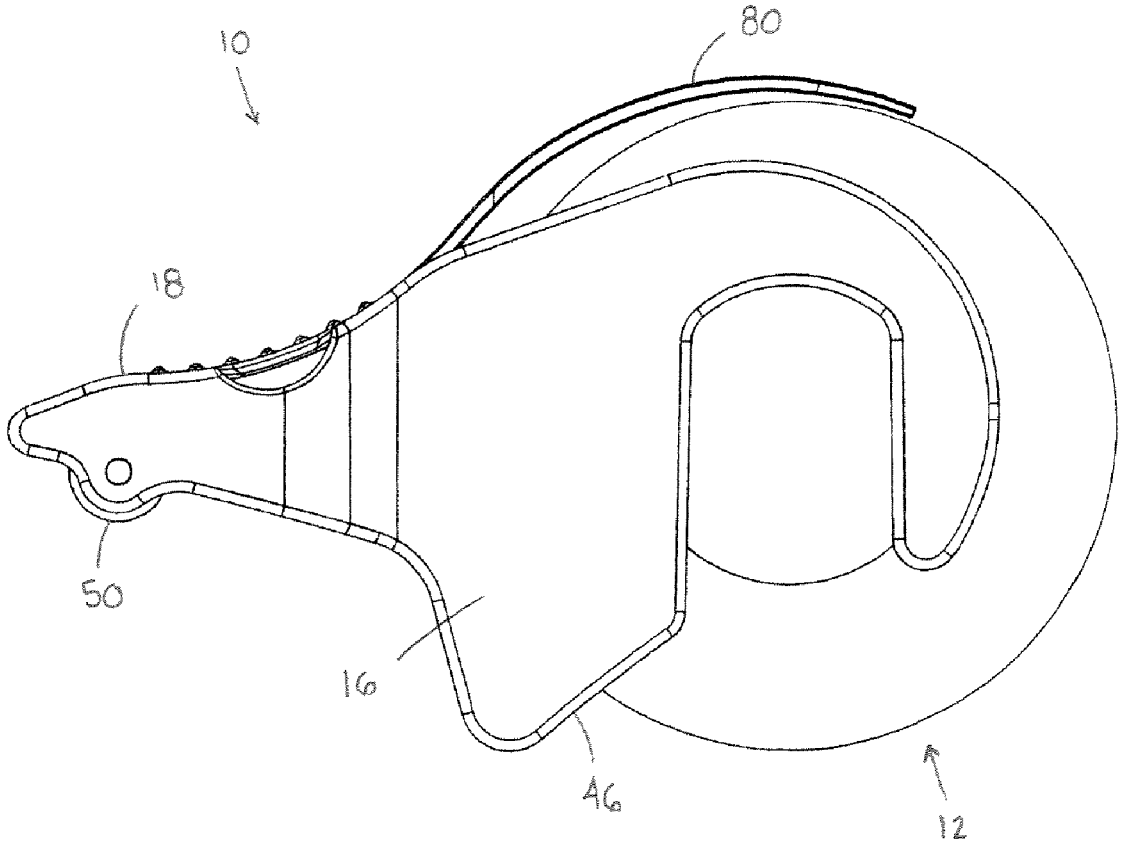
FIG. 3 is a side view of the tape dispenser of FIGS. 1 and 2.

It should, of course, be understood that the description and drawings herein are merely illustrative and that various modifications and changes can be made in the structures disclosed without departing from the present disclosure. Referring now to the drawings, wherein like numerals refer to like parts throughout the several views, FIGS. 1-3 depict an exemplary tape dispenser 10 for a roll of tape 12. The roll of tape 12 is conventional in construction and includes a cylindrical core, formed from either plastic or cardboard material, with a length of adhesive tape wound upon the core in many turns. In the depicted exemplary embodiment, a two (2) inch wide or 48 mm wide packaging tape is used. The inside diameter of the core of the depicted embodiment is 1½ inches. A smaller core can be used with the tape dispenser 10. The packaging tape used is a polypropylene film (sometimes referred to as a backing) with adhesive coated on one side of the film; although, alternative packaging tapes are contemplated.

For ease of description, the following conventions will be adopted with reference to the tape dispenser 10 as seen in the figures. Forward means toward a cutter 62. Rearward means away from the cutter 62 and toward hub structures 22, 24. Top or upper refers to that portion of the tape dispenser 10 or the direction of the tape dispenser toward a tape guide portion 18 and away from foot portions 44, 46. Inward means projecting from one sidewall 14 toward the other sidewall 16 of the tape dispenser.

With reference to FIGS. 4-11, the tape dispenser 10 comprises a right sidewall 14, a left sidewall 16 and a tape guide portion 18. The right and left sidewalls 14, 16 are mirror images of one another, therefore detailed description of the left sidewall 16 will be omitted for conciseness. The right sidewall 14 is generally planar and includes a hub structure 22. The hub structure 22 extends inwardly from the rear portion of the right sidewall 14 and comprises a generally U-shaped flange 26 which is inverted when the tape dispenser is seen in the upright position of FIG. 5-7.

The U-shaped flange 26 has a forward vertical leg portion 32, a rearward vertical leg portion 34 and a connecting top portion 36 having a curved shape. A forward horizontal rib 38 projects forwardly from the forward side of the forward vertical leg portion 32. A rearward horizontal rib 40 projects rearwardly from the rearward vertical leg portion 34. The horizontal ribs 38, 40, are generally coplanar. As can be best seen in FIGS. 8 and 9, the forward vertical leg portion 32 projects inwardly a first given uniform distance over its entire length and the rearward vertical leg portion 34 projects inwardly a second given uniform distance greater than the first given distance. The length of projection of the connecting top portion 36 varies over its length so that the entire hub structure 22 has an inwardly facing edge in a plane which diverges from the plane of the sidewall 14 in the rearward direction. This edge continues with respect to the forward horizontal rib 38 and the rearward horizontal rib 40 in that the inward edges are also in this plane. The left side hub structure 24 of the left sidewall 16 is the mirror image of the right side hub structure 22. All of the elements of the hub structures 22, 24 are identical except for this mirror image symmetry.

Figure 5:
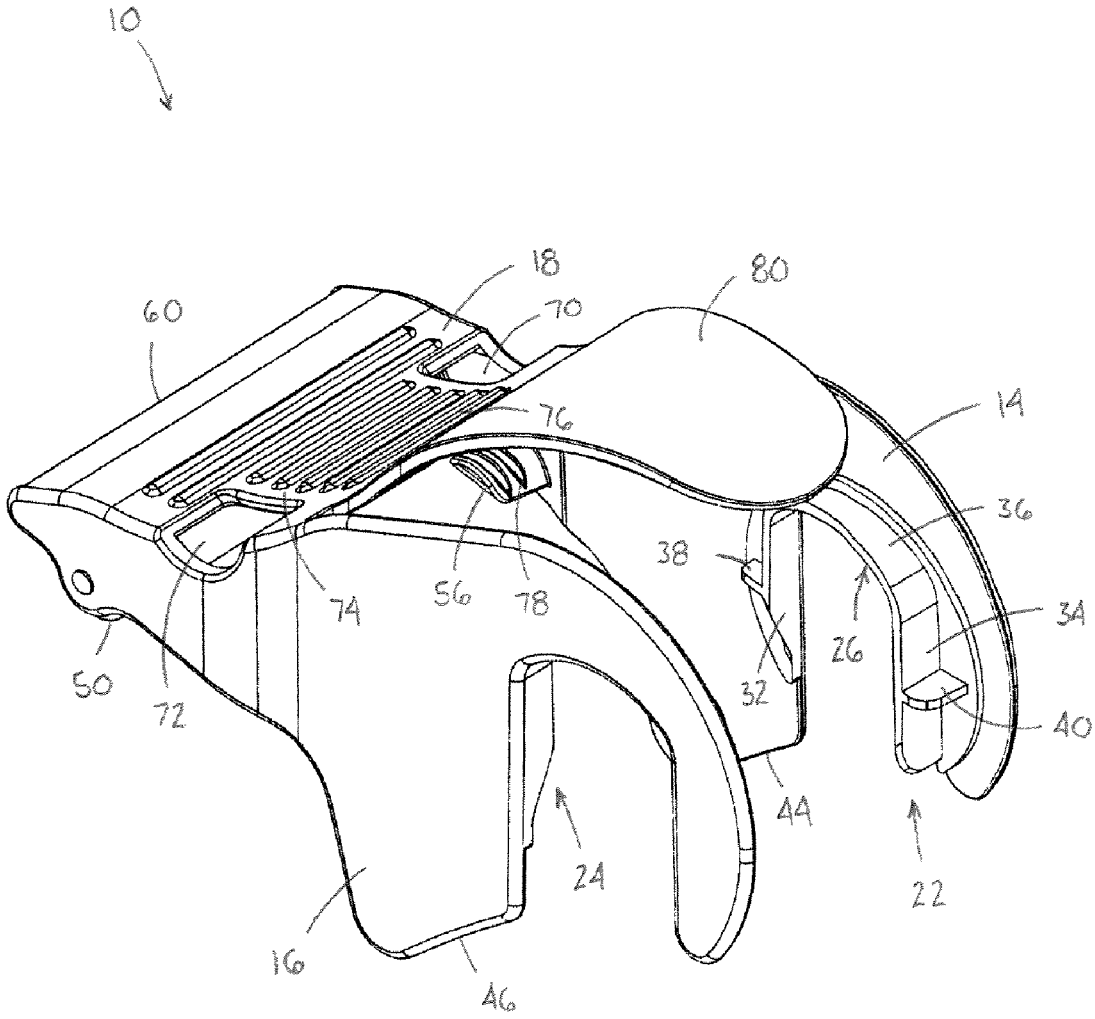

As can be best seen in FIGS. 5-7, the hub structures 22, 24 are hollow within the inverted U-shaped flanges 26. This allows a user to insert a finger and thumb into the hub structures 22, 24 while gripping the dispenser 10 and roll of tape 12. Additionally, as can be best seen in FIGS. 1 and 2, the flanges 26 with ribs 38, 40, provide good support for the interior cylindrical surface of the core of the roll of tape 12. The ribs 38, 40 are roughly on a diameter of the tape core while the connecting top portion 36 supports the top of the tape core. The bottoms of the leg portions 32, 34 prevent the tape core from riding up on the dispenser.

Further, when one is applying tape to a substrate, such as, for example, flaps of a box to close the box, the direction of force on the tape and thus the tape core is in a forward direction. Having the rearward vertical leg portion 34 project more deeply into the core of the roll of tape 12 assures that the roll of tape 12 does not pull forward within the tape dispenser 10 during dispensing. Moreover, the sloped nature of the inward edges of the hub structures 22, 24 allows for convenient loading of the roll of tape 12. The roll of tape is loaded by moving the right sidewall 14 away from the left sidewall 16. As the right and left sidewalls 14, 16 are connected to the tape guide portion 18 at their forward portions, moving the sidewalls away from one another at the rear end causes the hub structures 22, 24 to move away from one another more at the rear end than at the front end resulting in the inner edges becoming closer to parallel. This allows for insertion of an appropriate width roll of tape without undue stress on the tape dispenser 10. The exemplary hub structures 22, 24 are an example of one manner of connecting the roll of tape 12 to the tape dispenser 10. Different hub structures are known in the tape dispensing art. Some different hub structures, such as arc portions of an incomplete circle and other known structures, may be used without departing from the scope of the invention disclosed herein.

With continued reference to FIGS. 5-7, moving forward from the hub structures 22, 24, the bottom edges of the right sidewall 14 and the left sidewall 16 extend downwardly to foot portions 44, 46. The left side foot portion 46 and the right side foot portion 44 are the lowest portions of the tape dispenser 10. A bottom of each foot portion is angled upwardly toward the rearward vertical leg portion 34. The right and left sidewalls 14, 16 have a significantly smaller height dimension forward of the right and left foot portions 44, 46. This raises the bottom end of each sidewall 14, 16 well above the foot portion 44, 46. The relationship between the foot portions 44, 46 and the roll of tape 12 can be seen best in FIGS. 2 and 3. There, it is seen that the tape dispenser 10 can be placed upon a horizontal surface with the bottom of the roll of tape 12 and the foot portions 44, 46 supporting the tape dispenser 10 and roll of tape 12 in a stable position. The advantages of this position and other structures of the tape dispenser 10 will be explained more fully hereinafter.

With particular reference to FIGS. 6, 7 and 9-11, the tape dispenser 10 further comprises a roller 50. The roller 50 is generally cylindrical in shape with smaller cylindrical end portions extending from each end. The right end portion 52 of the roller 50 is supported in hole in the right sidewall 14. The left end portion 54 of the roller 50 is supported in a similar hole in the left sidewall 16. As the end portions 52, 54 are coaxial with the roller 50, the roller 50 is thereby rotatably supported between the right and left sidewalls 14, 16. The exemplary roller 50 is slightly less than about ½ inch (12 mm) in diameter. A roller of about ½ inch diameter or slightly smaller is large enough to apply application pressure to the tape and small enough to allow a compact design.

The tape dispenser 10 further comprises tape retaining tabs 56, 58 which project inwardly from the respective right and left sidewalls 14, 16. A top surface of the right tape retaining tab 56 can be seen in FIGS. 5 and 8. The top surface of the right tape retaining tab 56 is generally convex and at least one ridge. In the depicted exemplary embodiment, the top surface has two parallel ridges 78 which are also parallel to the right sidewall 14. An end portion of the tape retaining tab 56 is angled upwardly towards the tape guide portion 18. The left tape retaining tab 58 is the mirror image of the right tape retaining tab 56 and has identical ridges 78.

Referring to FIGS. 8 and 9, the tape guide portion 18 is seen to interconnect the forward portion of the right sidewall 14 and the forward portion of the left sidewall 16. With the exceptions to be described hereinafter, the tape guide portion 18 has a top surface which is generally flat across its width but somewhat curved in a front to back direction. The front edge 60 of the tape guide portion 18 is straight and is spaced slightly rearwardly from the forwardmost end or tips 64, 66 of the right and left sidewalls 14, 16. A cutter 62 extends slightly from the front edge 60 but not beyond the forwardmost tips 64, 66 of the right sidewall 14 and left sidewall 16. In the depicted embodiment, the cutter 62 is a serrated metal blade fixed to the front edge 60 of the tape guide portion. However, in some applications, a serrated front edge 60 may perform the functions of the cutter 62. Proceeding rearwardly from the front edge 60, the tape guide portion 18 is somewhat convex in the forward to rearward direction. This portion of the tape guide 18 covers the roller 50. As seen in FIGS. 6 and 11, strengthening ribs 68 can extend downwardly from the underside of the tape guide portion 18. The strengthening ribs 68 are generally parallel to the sidewalls 14, 16.

Figure 4:
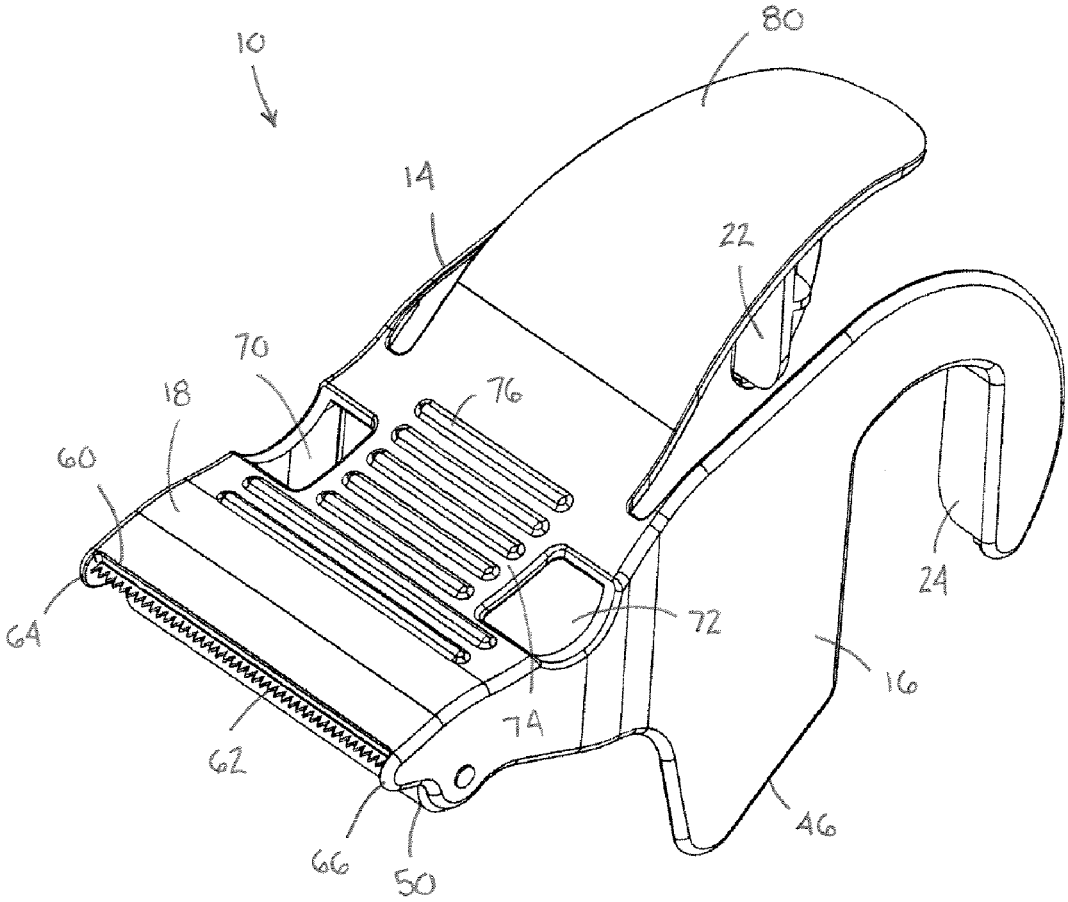

Rearward of the strengthening ribs 68 and above the tape retaining tabs 56, 58, apertures 70, 72 are provided in the tape guide portion 18. One function of the apertures 70, 72 is to facilitate molding of the tape retaining tabs 56, 58. The tape guide portion 18 is curved, for example generally convex, in the forward to rearward direction in the vicinity of the apertures 70, 72. As shown in FIG. 4, this curve forms a gentle trough 74 extending across the width of the tape dispenser 10. Transverse bars 76 can be provided in the top surface of the tape guide portion 18 between the apertures 70, 72 and adjacent the apertures 70, 72. These transverse bars 76 provide a convenient gripping area for a finger of a hand used in dispensing tape with this tape dispenser 10.

The tape guide portion 18 extends from the right sidewall 14 to the left sidewall 16 behind the apertures 70, 72. Thus, the sidewalls 14, 16 are interconnected by the tape guide portion 18 forward of the apertures 70, 72 and rearward of the apertures 70, 72. However, the length of interconnection between the sidewalls 14, 16 and behind the apertures 70, 72 is short. The length of interconnection behind the apertures 70, 72 is about ¼ of an inch for a tape dispenser designed to accommodate a 2 inch wide roll of tape. Extending rearwardly from the tape guide portion 18 is a tape brake 80. The tape brake 80 is connected to and integral with the tape guide portion 18, but not as wide as the tape guide portion 18. Thus, the tape brake 80 is not connected to the sidewalls 14, 16 at all. Rather, there is a gap between the sides of the tape brake 80 and the sidewalls 14, 16 over the entire length of the tape brake 80. The tape brake 80 tapers from its widest portion adjacent the tape guide portion 18 to a narrower portion above and slightly behind the axis of the roll of tape 12. As can be seen in FIGS. 1 and 3, the tape brake 80 is generally straight in the transverse direction and roughly follows the convex shape of the top of the roll of tape 12 in the direction from front to rear of the tape dispenser 10.

The tape dispenser 10 described above is conveniently sold and used with polypropylene film based packaging tape wound upon a single core. Some tape products are wound upon double cores in which an inner core rides upon a hub and an outer core supports the length of tape. The two cores are interconnected by an annular ring. This type of core is sometimes used in tapes which would otherwise have a telescoping problem. A single core can be used in the present application as polypropylene tape is less liable to telescoping, particularly in a two (2) inch width. However, other polymer film based tapes may also be used.

In operation, the roll of tape 12 is loaded into the tape dispenser 10 by spreading the right and left sidewalls 14, 16 slightly apart, and inserting the roll of tape 12 until the hub structures 22, 24 are positioned adjacent the interior of the core of the roll of tape 12. The sidewalls 14, 16 are then brought together securing the roll in place. The end of the tape upon the roll is separated from the roll of tape and threaded above the tape retaining tabs 56, 58 and below the roller 50. The roll of tape 12 and tape dispenser 10 are now ready for use. In this configuration the tape dispenser 10 and roll of tape 12 may be placed on a substrate, the tape dispenser resting upon the bottom of the roll of tape 12 and the foot portions 44, 46. The end of the tape is held off the surface of the substrate upon which the dispenser is sitting because the foot portions 44, 46 hold the tape retaining tabs 56, 58 sufficiently above the surface upon which they rest to protect the end of the tape.

The tape dispenser 10 is configured to allow a user to only use one hand to hold the tape dispenser and dispense a length of tape on the substrate. To dispense tape, a consumer picks up the tape dispenser 10, grasping the sidewall and tape guide as is convenient and applies the end of the tape onto the substrate under the roller 50 with a slightly downward and backward motion. The end of the tape is caught between the substrate and the roller 50. The roller 50 applies pressure generally perpendicular to the tape and substrate but minimizes friction in the longitudinal direction so that wrinkling of the tape or pulling of the tape along the substrate is avoided. Rather, the tape is encouraged to adhere to the substrate. As tape is applied, the foot portions 44, 46 act as guides maintaining the tape dispenser 10 at an appropriate angle with respect to the substrate, tape and the roller to encourage appropriate pressure on the roller. This results in obtaining good adhesion of the tape to the substrate across the width of the tape. When the consumer has applied an appropriate length of tape to the substrate, the consumer may rotate the rear portions of the tape dispenser 10 upwardly with respect to the roller 50 thereby bringing the very forward ends of the sidewalls 14, 16 into contact with the substrate and the cutter 62 into contact with the tape, cutting the length of tape applied free of the roll of tape 12. As can be seen in FIGS. 7 and 9, the distance between the forward edges of the tape retaining tabs 56, 58 and the roller 50 is much less than the distance between the forward edges of the tape retaining tabs 56, 58 and the foot portions 44, 46. The free end of the tape therefore will not come in contact with the substrate upon which the tape dispenser is placed between uses. The end of the tape forward of the tape retaining tabs 56, 58 is simply too short to reach the substrate upon which the dispenser and roll of tape is placed.

As can be seen in FIG. 8, and as described above, the tape retaining tabs have ridges 78 extending in the direction of tape dispensing. These ridges 78 minimize the area of contact between the adhesive side of the tape and the tape retaining tabs 56, 58. This allows the tape to slide over the tape retaining tabs 56, 58 without sticking or binding but still be retained above the tape retaining tabs 56, 58 both during dispensing and at rest.

The frame of the tape dispenser 10, that is the sidewalls 14, 16 and tape guide position 18, are molded as a unit. The sidewalls are provided with gentle tapers, or draft, to facilitate molding. The tape dispenser 10 is preferably molded from polypropylene which has appropriate flexibility and stiffness characteristics for this dispenser while also being relatively inexpensive. However, polystyrene and other polymer materials may also be used.

As is evident from the foregoing, the improved tape dispenser 10 is adapted to allow a user to only use one hand to hold the tape dispenser and dispense a length of tape on the substrate from the roll of tape 12 wound upon a cylindrical core. The tape dispenser comprises a one piece frame molded from polymeric material having two generally planar sidewalls 14, 16 with inwardly projecting hub structures 22, 24 and inwardly projecting tape retaining tabs 56, 58. The two sidewalls are interconnected by the tape guide portion 18 which carries the cutter 62 forward of the tabs. The sidewalls also include downwardly extending foot portions 46, 48 forward of the roll of tape allowing the tape dispenser to be placed on a surface in a stable position protecting the adhesive side of the tag end of the roll of tape. The top forward edge of the tape retaining tabs 56, 58 are closer to the cutter 62 than to the bottom of the foot portions 46, 48 whereby the end of the roll of tape is held off of the surface upon which the dispenser is rested. The hub structures 22, 24 on the sidewalls are inverted U-shaped flanges which are hollow inside allowing for an easy grip of the dispenser. The tape guide portion 18 includes a trough 74 extending between the two sidewalls providing for an improved grip of the dispenser and a tape brake 80 extending rearwardly from the tape guide portion above the roll of tape allowing control of the dispensing of tape.

The tape dispenser 10 conveniently holds and dispenses rolls of packaging tape which is also inexpensive to manufacture and convenient to use. The tape dispenser 10 protects the loose end of the roll of tape from contact with unintended surfaces. The tape dispenser has a pressure roller 50 allowing a user to positively engage the tape to a substrate without dragging the tape on the substrate. The tape dispenser is inexpensive to manufacture, easy to use, and reliably applies tape to a substrate with appropriate pressure.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A tape dispenser adapted to dispense lengths of adhesive tape from a roll of adhesive tape wound upon a cylindrical tape core, the tape dispenser comprising:

a first sidewall having a hub structure, a tape retaining tab having at least one ridge extending in a direction generally parallel to the first sidewall, and a foot portion located between the hub structure and the tab;

a second sidewall generally parallel to the first sidewall, the second sidewall having a hub structure, a tape retaining tab having at least one ridge extending in a direction generally parallel to the second sidewall, and a foot portion located between the hub structure and the tab, the tape core being rotatably supported on the hub structures of the first and second sidewalls;

a tape guide portion interconnecting the first and second sidewalls;

a cutter located at a forward end of the tape guide portion; and a roller rotatably supported between the sidewall front portions, the roller being beneath the tape guide portion and adjacent the cutter, wherein the tape dispenser is configured to allow a user to only use one hand to hold the tape dispenser and dispense a length of tape on an associated substrate.

2. The tape dispenser of claim 1, wherein the tape guide portion has at least at least two ridges extending in a direction generally perpendicular to the first and second sidewalls, the at least two ridge providing a convenient gripping area for a user of the tape dispenser.

3. The tape dispenser of claim 1, wherein each hub structure includes an inwardly extending flange having a top portion, a rear leg portion extending downwardly from the top portion and a front leg portion extending downwardly from the top portion, each sidewall having an opening at least partially surrounded by the flange, whereby the tape dispenser may be grasped by a user inserting fingers into the sidewall openings.

4. The tape dispenser of claim 3, wherein each hub structure includes a rear rib extending rearwardly from the rear leg portion and a front rib extending forwardly from the front leg portion, wherein the rear and front ribs and the top portion of each hub rotatably structure supports the tape core.

5. The tape dispenser of claim 1, wherein the tape guide portion has a trough extending between the first sidewall and the second sidewall rearwardly of the cutter.

6. The tape dispenser of claim 1, further comprising a tape brake extending rearwardly from the tape guide portion to a point generally above the hub structures of the first and second sidewalls, the tape brake being unconnected to the first sidewall and the second sidewall.

7. The tape dispenser of claim 1, wherein the cutter is positioned rearward of a forwardmost end of each sidewall.

8. The tape dispenser of claim 1, wherein the tape guide portion includes at least one strengthening rib extending downwardly from an underside of the tape guide portion, the at least one strengthening rib being generally parallel to the first and second sidewalls.

9. The tape dispenser of claim 1, wherein the roller has an outer diameter of about one half inch.

10. The tape dispenser of claim 9, wherein the roller has an outer diameter of slightly less than one half inch.

11. A tape dispenser adapted to dispense lengths of adhesive tape from a roll of adhesive tape wound upon a cylindrical tape core, the tape dispenser comprising:

a one piece frame including:

a first generally planar sidewall having a front portion, a rear portion, an inwardly projecting hub structure in the rear portion, an inwardly projecting tape retaining tab in the front portion, and a foot portion having a bottom positioned between the hub structure and the tab and below the hub structure, a second generally planar sidewall generally parallel to the first sidewall the second sidewall having a front portion, a rear portion, an inwardly projecting hub structure in the rear portion, an inwardly projecting tape retaining tab in the front portion, and a foot portion having a bottom positioned between the hub structure and the tab and below the hub structure, and a tape guide portion generally perpendicular to the first and second sidewalls and connecting the sidewall front portions, the tape guide portion having a forward end;

a cutter at the forward end of the tape guide portion;

a cylindrical roller, separate from the one piece frame, rotatably supported between the sidewall front portions; and, each of said tape retaining tabs having a top surface and a forward edge, the top surface having at least one ridge extending in a direction parallel to the sidewalls, and the distance from the tab forward edges to the cutter is less than the distance from the tab forward edges to the foot portion bottoms whereby an end of a tape being dispensed will not contact an associated surface upon which the tape dispenser is located when resting on said two feet.

12. The tape dispenser of claim 11, wherein the first sidewall and the second sidewall are mirror images of one another.

13. The tape dispenser of claim 11, wherein the hub structures are generally perpendicular to the sidewalls and have an inverted U shape, each hub structure comprising a curved top portion, a rear straight leg portion extending downwardly from the top and a front straight leg portion extending downwardly from the top portion, the sidewalls being hollow within the inverted U shapes, whereby the tape dispenser may be grasped by a user inserting fingers into the hollows.

14. The tape dispenser of claim 13, wherein each hub structure includes a rear rib extending rearwardly from the rear straight leg portion and a front rib extending forwardly from the front straight leg portion.

15. The tape dispenser of claim 11, further including a tape brake extending rearwardly from the tape guide portion to a point above the hub structures, the tape brake being unconnected to the first sidewall and the second sidewall and having a contour substantially mirroring the roll of tape.

16. The tape dispenser of claim 11, wherein the foot portions of the first and second sidewalls are configured to maintain the tape dispenser at an appropriate angle with respect to the associated substrate, the tape and the roller thereby allowing the roller to apply pressure generally perpendicular to the tape and the associated substrate during dispensing of a length of tape on the associated substrate.

17. A tape dispenser adapted to dispense lengths of adhesive tape from a roll of adhesive tape wound upon a cylindrical tape core, the tape dispenser comprising:

a first sidewall having an inwardly extending hub structure, an inwardly extending tape retaining tab having at least one ridge extending in a direction generally parallel to the first sidewall, and a foot portion located between the hub structure and the tab;

a second sidewall generally parallel to the first sidewall, the second sidewall having an inwardly extending hub structure, an inwardly extending tape retaining tab having at least one ridge extending in a direction generally parallel to the second sidewall, and a foot portion located between the hub structure and the tab, the tape core being rotatably supported on the hub structures of the first and second sidewalls, the tape retaining tabs being configured to allow the tape to slide over the tabs without sticking or binding but still be retained above the tabs during dispensing of a length of tape on an associated substrate and at rest;

a tape guide portion interconnecting the first and second sidewalls;

a tape brake extending rearwardly from the tape guide portion, the tape brake being unconnected to the first sidewall and the second sidewall;

a cutter located at a forward end of the tape guide portion; and a roller rotatably supported between the sidewall front portions, the roller being beneath the tape guide portion and adjacent the cutter.

* * * * *